252-98 AU 157 EX
6/10/86 XR 4,594,184

United States Patent [19]

Cook et al.

[11] Patent Number: 4,594,184

[45] Date of Patent: Jun. 10, 1986

[54] CHLORINE BLEACH COMPATIBLE LIQUID DETERGENT COMPOSITIONS

[75] Inventors: Thomas E. Cook, Cincinnati; John C. Dyer, Fairfield; Manuel G. Venegas, Cincinnati, all of Ohio

[73] Assignee: The Procter & Gamble Company, Cincinnati, Ohio

[21] Appl. No.: 737,293

[22] Filed: May 23, 1985

[51] Int. Cl.[4] ..... C11D 1/86; C11D 3/28

[52] U.S. Cl. ..... 252/542; 252/110; 252/117; 252/118; 252/174.12; 252/524; 252/526; 252/528; 252/532; 252/535; 252/539; 252/540; 252/545; 252/547; 252/551; 252/558; 252/559; 252/DIG. 14; 252/529; 252/548; 252/98; 252/102

[58] Field of Search ..... 252/524, 526, 542, 545, 252/DIG. 14, 558, 551, 117, 118

[56] References Cited

U.S. PATENT DOCUMENTS 2,618,606 11/1952 Schaeffer ..... 252/524
2,992,966 7/1961 Harris ..... 252/542

FOREIGN PATENT DOCUMENTS 652339 4/1951 United Kingdom .

*Primary Examiner*—Prince E. Willis
*Attorney, Agent, or Firm*—Darla P. McVicar; Richard C. Witte; Thomas H. O'Flaherty

[57] ABSTRACT

Heavy-duty liquid detergents containing a neutralization system comprising bleach compatible bicyclic tertiary amines and imines; anionic surfactant; ethoxylated nonionic surfactant; optional quaternary ammonium, amine, amide, or amine oxide surfactant; preferably fatty acid and/or polycarboxylate builders; and a solvent system comprising ethanol, polyol and/or water. The compositions are isotropic liquids providing a high level of detergency performance.

14 Claims, No Drawings

CHLORINE BLEACH COMPATIBLE LIQUID DETERGENT COMPOSITIONS

TECHNICAL FIELD

The present invention relates to heavy-duty liquid detergent compositions containing anionic surfactant (preferably comprising sulfonate surfactant and/or alcohol ethoxylate sulfate surfactant); ethoxylated nonionic surfactant; optional quarternary ammonium, amine, amide, and/or amine oxide surfactant; preferably, saturated fatty acid and polycarboxylate builders; a neutralization system comprising tertiary bicyclic amines, and a solvent system preferably comprising ethanol, and/or polyol and water. The compositions are isotropic liquids which provide a high level of detergency performance.

There has been considerable demand for liquid detergents capable of providing superior cleaning under a wide variety of laundering conditions. Such compositions generally require a number of ingredients which tend to separate into discrete phases. Isotropic liquid detergents are desired for both consistency of performance and aesthetic reasons. The compositions should remain isotropic during shipping and storage, where temperatures of 55° F. (12.8° C.) or lower are often encountered. They preferably are also formulated to recover, after freezing and thawing, to an isotropic phase prior to consumer use.

Liquid detergents often contain high levels of alkanolamines to enhance performance and product stability. However, alkanolamines readily react with and destroy chlorine bleaches. The bicyclic tertiary amines and imines of the present invention allow reduction or elimination of the alkanolamines without a reduction in stability or performance. Because the bicyclic tertiary amines of the invention are bleach-compatible, consumers who add chlorine bleaches to wash solutions obtain better bleaching performance than with detergents containing larger amounts of alkanolamines.

BACKGROUND ART

Pending U.S. Pat. No. 4,561,998, Wertz et al, issued Dec. 31, 1985, discloses detergent compositions containing anionic surfactants, quarternary ammonium, amine or amine oxide surfactants, and fatty acids, and formulated to provide a near-neutral wash pH. The compositions are preferably liquid detergents which additionally contain ethoxylated nonionic surfactants and polycarboxylate builders.

U.S. Pat. No. 4,285,841, Barrat et al, issued Aug. 25, 1981, discloses liquid detergents containing anionic surfactants, nonionic surfactants and from about 8% to about 20% by weight of a fatty acid. The compositions have a pH of from about 6.0 to about 7.5.

U.S. Pat. No. 4,287,082, Tolfo et al, issued Sept. 1, 1981, discloses liquid detergents containing saturated fatty acids, enzymes, enzyme-accessible calcium and short-chain carboxylic acid salts, preferably formates.

U.S. Pat. No. 4,507,219, Hughes, issued Mar. 26, 1985, discloses stable liquid detergent compositions with amine bases.

SUMMARY OF THE INVENTION

The present invention encompasses heavy-duty liquid detergent compositions comprising, by weight:

(a) from about 10% to about 35%, of anionic surfactant on an acid basis, preferably:
  (i) from about 5% to about 15% of sulfonate surfactant containing a $C_{10}$–$C_{16}$ alkyl or alkenyl group; and
  (ii) from about 5% to about 18%, on an acid basis, of alcohol ethoxylate sulfate surfactant of the formula $RO(C_2H_4O)_mSO_3M$, wherein R is a $C_{10}$–$C_{16}$ alkyl or hydroxyalkyl group, m is from about 0.5 to about 4, and M is a compatible cation;

(b) from 0% to about 15% of an ethoxylated nonionic surfactant of the formula $R^1(OC_2H_4)_nOH$, wherein $R^1$ is a $C_{10}$–$C_{16}$ alkyl group or a $C_8$–$C_{12}$ alkylphenyl group, n averages from about 3 to about 9, and said nonionic surfactant has an HLB of from about 10 to about 13;

(c) from about 0% to about 15% of a cosurfactant selected from the group consisting of:
  (i) quarternary ammonium surfactants having the formula:

$$[R^2(OR^3)_y][R^4(OR^3)_y]_2R^5N^+X^-$$

wherein $R^2$ is an alkyl or alkyl benzyl group having from about 6 to about 16 carbon atoms in the alkyl chain; each $R^3$ is selected from the group consisting of $—CH_2CH_2—$, $—CH_2CH(CH_3)—$, $—CH_2CH(CH_2OH)—$, $—CH_2CH_2CH_2—$, and mixtures thereof; each $R^4$ is selected from the group consisting of $C_1$–$C_4$ alkyl, $C_1$–$C_4$ hydroxyalkyl, benzyl, and hydrogen when y is not 0; $R^5$ is the same as $R^4$ or is an alkyl chain wherein the total number of carbon atoms of $R^2$ plus $R^5$ is from about 8 to about 16; each y averages from 0 to about 10 and the sum of the y values is from 0 to about 15; and X is any compatible anion;

(ii) amine surfactants having the formula:

$$[R^2(OR^3)_y][R^4(OR^3)_y]R^5N$$

wherein $R^2$, $R^3$, $R^4$, $R^5$ and y are as defined above;

(iii) amine oxide surfactants having the formula:

$$[R^2(OR^3)_y][R^4(OR^3)_y]R^5N\rightarrow 0$$

wherein $R^2$, $R^3$, $R^4$, $R^5$ and y are as defined above;

(iv) an amide surfactant of the formula

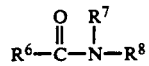

wherein $R^6$ is an alkyl, hydroxyalkyl or alkenyl radical containing from about 8 to about 20 carbon atoms, and $R^7$ and $R^8$ are each selected from the group consisting of hydrogen, methyl, ethyl, propyl, isopropyl, 2-hydroxyethyl, 2-hydroxypropyl, 3-hydroxypropyl, and wherein said radicals additionally contain up to about 5 ethylene oxide units, and, preferably, at least one of $R^7$ and $R^8$ contains a hydroxyl group; and (v) mixtures thereof;

(d) from about 0% to about 30% of builder, preferably;

(i) from 0% to about 20% of a $C_{10}$–$C_{14}$ saturated fatty acid, the weight ratio of $C_{10}$–$C_{12}$ fatty acid to $C_{14}$ fatty acid being at least 1; and (ii) from about 3% to about 20%, on an acid basis, of a water-soluble polycarboxylate builder material;

(e) a neutralization system, comprising from 0.5% to about 10% of bicyclic tertiary amine or imine; and, (f) a solvent system, preferably:

(i) from about 2% to about 10% ethanol; and/or (ii) from about 2% to about 15% of a polyol containing from 2 to 6 carbon atoms and from 2 to 6 hydroxy groups; and (iii) from about 10% to about 60% water.

Said compositions preferably contain from about 20% to about 40% of (a), (b), (c) and (d); said components being selected to provide an isotropic liquid at 55° F. (12.8° C.), preferably having an initial pH of from about 7.5 to about 8.5 at a concentration of about 10% by weight in water at 68° F. (20° C.).

DETAILED DESCRIPTION OF THE INVENTION

The liquid detergents of the present invention contain anionic surfactant, preferably a mixture of sulfonate and alcohol ethoxylate sulfate anionic surfactants; ethoxylated nonionic surfactant; optional quaternary ammonium, amine, amide, and/or amine oxide surfactants; builders, preferaby saturated fatty acid and/or, polycarboxylate builders; a neutralization system comprising bicyclic amine imine basis described hereinater; and a solvent system, preferably comprising ethanol, polyol and/or water.

The compositions herein are formulated to provide a high level of detergency performance under a wide variety of laundering conditions. Preferred compositions herein are isotropic liquids at 50° F. (10° C.). They preferably also recover, after freezing and thawing, to an isotropic form by 55° F. (12.8° C.), more preferably by 50° F. (10° C.).

The compositions also preferably have a solvent system comprising water and a mixture of ethanol and polyol. Polyols such as propylene glycol are especially preferred. Crystallization occurs without the polyol and unacceptably high gel points tend to occur without the ethanol. The amount of ethanol and polyol must also be sufficient to prevent organic phase separation (i.e., keep free fatty acids and poorly soluble surfactants in solution), and yet not be so high as to cause lye phase separation and/or crystallization by limiting the amount of water available.

The Neutralization System

Amines are useful in heavy duty liquid laundry detergents as organic bases and buffers. However, the conventional tertiary amines react with hypochlorite bleach under wash conditions. This reduces bleach efficiency as well as producing undesirable by-products such as aldehydes, and secondary amines.

Applicant has now discovered that certain bicyclic tertiary amines and imines are basic enough to be useful as buffers and are not degraded by hypochlorite bleach.

Acyclic tertiary amines are ordinarily degraded by hypochlorite. Secondary amines and aldehydes are formed. These compounds then react with bleach, further reducing bleach effectiveness and producing more undesirable by-products.

While not wishing to be bound by theory, it is believed that the tertiary amines of the invention are not degraded by hypochlorite bleach because of specific structural properties. Specifically, tertiary amines are bleach compatible if the nitrogen atom is held in a rigid bicyclic structure that also does not contain a heteroatom containing an electron pair three bonds distant from the amine nitrogen atom. The chemistry described hereinabove for acylic amines involves double bond formation to generate an iminium salt. This double bond formation is precluded by the rigid cyclic structure (Bredt's Rule). Thus, the chloramine formed generally has no pathway to degrade further and remains in in equilibrium with the free amine and hypochlorous acid as desired.

An exception is noted wherein a heteroatom containing a nonbonding electron pair exists three bonds distant from the amine nitrogen atom. Such compounds are outside the scope of the invention because they incur a special type of rearrangement and degradation in the presence of chlorine bleaches as described by Brenneisen et al. in Helv. Chim. Acta 1965, 48, 146 for (2.2.2)diazabicyclooctane (DABCO).

Without a viable pathway for decomposition, the chloroammonium salt remains in equilibrium with the free amine and HOCl as shown below for quinuclidine.

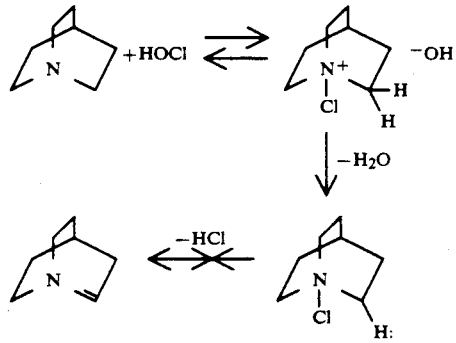

The amines/imines useful in the invention are those bicylic compounds designed so that the elimination of the intermediate chloroammonium salt forms strained anti-Bredt imminium salts, and the electron pair formed via proton extraction (from the carbon adjacent to nitrogen) cannot achieve the desirable anti-periplanar position suitable for elimination of chloride.

Preferred compounds include quinuclidine, hexamethylene tetra-amine and 1,8-diazobicyclo [5.4.0] undec-7-ene (DBU).

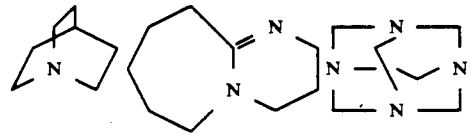

Especially preferred are quinuclidine and 1,8-diazobicyclo [5.4.0] undec-7-ene.

The liquid detergent compositions of the invention comprise from about 0.5% to about 10%, preferably from about 1% to about 5% of a bicyclic tertiary amine or imine in the neutralization system.

The total level of organic bases should also be selected to provide a sufficiently high product pH to minimize the level of poorly-soluble free fatty acids without being so high that pH sensitive stain removal, enzyme stability and greasy/oily soil removal are compromised.

The Anionic Surfactant

The anionic surfactant herein can comprise any of the synthetic anionic surfactants conventionally used in heavy duty laundry detergents including alkyl benzene sulfonates, alkyl sulfates, alkyl polyethoxylate sulfates, olefin sulfonates, paraffin sulfonates, etc. Mixtures can also be used. Suitable synthetic anionic surfactants are disclosed in detail in U.S. Pat. No. 3,929,678, Laughlin et al, issued Dec. 30, 1975 and incorporated herein by reference.

Preferred synthetic anionic surfactants include the sulfonates, the alkyl sulfates, and alkylpolyethoxylate ether sulfates discussed more specifically below.

Sulfonate Surfactant

The detergent compositions herein preferably contain from about 5% to about 15%, more preferably from about 6% to about 12%, by weight (on an acid basis) of an anionic sulfonate surfactant containing a $C_{10}$–$C_{16}$ alkyl or alkenyl group. Anionic sulfonate surfactants useful herein are disclosed in U.S. Pat. 4,285,841, Barrat et al, issued Aug. 25, 1981, and in U.S. Pat. No. 3,919,678, Laughlin et al, issued Dec. 30, 1975, both incorporated herein by reference.

Preferred sulfonate surfactants are the water-soluble salts, particularly the alkali metal, and alkanolammonium (e.g., monoethanolammonium or triethanolammonium) salts of alkylbenzene sulfonates in which the alkyl group contains from about 10 to about 15 carbon atoms, in straight chain or branched chain configuration, e.g., those of the type described in U.S. Pat. Nos. 2,220,099 and 2,477,383, incorporated herein by reference. Especially valuable are linear straight chain alkylbenzene sulfonates in which the average number of carbon atoms in the alkyl group is from about 11 to about 13.

Also useful herein are the water-soluble salts of paraffin sulfonates, olefin sulfonates, alkyl glyceryl ether sulfonates, esters of $\alpha$-sulfonated fatty acids containing from about 1 to 10 carbon atoms in the ester group, 2-acyloxy-alkane-1-sulfonates containing from about 2 to 9 carbon atoms in the acyl group, and $\beta$-alkyloxy alkane sulfonates containing from about 1 to 3 carbon atoms in the alkyl group.

Mixtures of the above-described sulfonates, particularly with the $C_{11-13}$ linear alkylbenzene sulfonates, can also be used.

Alcohol Ethoxylate Sulfate Surfactant

The present compositions also preferably contain an alcohol polyethoxylate ether sulfate surfactant of the formula $RO(C_2H_4O)_mSO_3M$, wherein R is a $C_{10}$–$C_{16}$ alkyl (preferred) or hydroxyalkyl group, m is from about 0.5 to about 4, and M is a compatible cation. This surfactant preferably represents from about 5% to about 18%, more preferably from about 9% to about 14%, by weight (on an acid basis) of the composition.

Preferred alcohol ethoxylate sulfate surfactants of the above formula are those wherein the R substituent is a $C_{12-15}$ alkyl group and m is from about 1.5 to about 3. Examples of such materials are $C_{12-15}$ alkyl polyethoxylate (2.25) sulfate ($C_{12-15}E_{2.25}S$); $C_{14-15}E_{2.25}S$; $C_{12-13}E_{1.5}S$; $C_{14-15}E_3S$; and mixtures thereof. The sodium, potassium, monoethanolammonium, and triethanolammonium salts of the above are preferred.

Ethoxylated Nonionic Surfactant

The compositions also preferably contain from about 2% to about 15%, more preferably from about 4% to about 12%, by weight of an ethoxylated nonionic surfactant of the formula $R^1(OC_2H_4)_nOH$, wherein $R^1$ is a $C_{10}$–$C_{16}$ alkyl group or a $C_8$–$C_{12}$ alkylphenyl group, n is from about 3 to about 9, and said nonionic surfactant has an HLB (hydrophile-lipophile balance) of from about 10 to about 13. These surfactants are more fully described in U.S. Pats. No. 4,285,841, Barrat et al, issued Aug. 25, 1981, and 4,284,532, Leikhim et al, issued Aug. 18, 1981, both incorporated herein by reference. Particularly prefererd are condensation products of $C_{12}$–$C_{14}$ alcohols with from about 3 to about 8 moles of ethylene oxide per mole of alcohol, e.g., $C_{12}$–$C_{13}$ alcohol condensed with about 6.5 moles of ethylene oxide per mole of alcohol.

The ethoxylated nonionic surfactants herein have an HLB (hydrophilic-lipophilic balance) of from about 5 to about 17, preferably from about 6 to about 13. HLB is defined in detail in Nonionic Surfactants, by M. J. Schick, Marcel Dekker, Inc., 1966, pages 607–613, incorporated herein by reference. Suitable ethoxylated nonionic surfactants herein are as follows:

(1) The polyethylene oxide condensates of alkylphenols. These compounds include the condensation products of alkylphenol having an alkyl group containing from about 6 to 12 carbon atoms in either a straight chain or branched chain configuration with ethylene oxide, said ethylene oxide being present in an amount equal to 3 to 25 moles of ethylene oxide per mole of alkyl phenol.

Examples of compounds of this type include nonylphenol condensed with about 9.5 moles of ethylene oxide per mole of nonylphenol; dodecylphenol condensed with about 12 moles of ethylene oxide per mole of phenol; dinonylphenol condensed with about 15 moles of ethylene oxide per mole of phenol; and diisooctylphenol condensed with about 15 moles of ethylene oxide per mole of phenol. Commercially available nonionic surfactants of this type include Igepal CO-630, marketed by the GAF Corporation, and Triton X-45, X-114, X-100, and X-102, all marketed by the Rohm & Haas Company.

(2) The condensation products of aliphatic alcohols with from about 1 to about 25 moles of ethylene oxide. The alkyl chain of the aliphatic alcohol can either be straight or branched primary or secondary, and generally contains from about 8 to about 22 carbon atoms. Examples of such ethoxylated alcohols include the condensation product of myristyl alcohol condensed with about 10 moles of ethylene oxide per mole of alcohol; and the condensation product of about 9 moles of ethylene oxide with coconut alcohol (a mixture of fatty alcohols with alkyl chains varying in length from 10 to 14 carbon atoms). Examples of commercially available nonionic surfactants in this type include Tergitol 15-S-9, marketed by Union Carbide Corporation, Neodol 45-9, Neodol 23-6.5, Neodol 45-7, and Neodol 45-4, marketed by Shell Chemical Company, and Kyro EOB, marketed by The Procter & Gamble Company.

(3) Mixtures of the above.

Preferred ethoxylated nonionic surfactants are of the formula $R^1(OC_2H_4)_nOH$, wherein $R^1$ is a $C_{10}$–$C_{16}$ alkyl group or a $C_8$–$C_{12}$ alkylphenyl group, n is from about 3 to about 9, and said nonionic surfactants has an HLB (hydrophile-lipophile balance) of from about 9 to about 13, preferably from about 10 to about 13.

Cosurfactant

The compositions herein can also contain from 0% to about 15%, preferably from about 0.5% to about 3%, by weight of a cosurfactant selected from certain quaternary ammonium, amine, amide and/or amine oxide surfactants. The quaternary ammonium and amide surfactants are particularly preferred.

The quaternary ammonium surfactants useful herein are of the formula:

$$[R^2(OR^3)_y][R^4(OR^3)_y]_2R^5N^+X^-$$

wherein $R^2$ is an alkyl or alkylbenzyl group having from about 6 to about 16 carbon atoms in the alkyl chain; each $R^3$ is selected from the group consisting of $—CH_2CH_2—$, $—CH_2CH(CH_3)—$, $—CH_2CH(CH_2OH)—$, $—CH_2CH_2CH_2—$, and mixtures thereof; each $R^4$ is selected from the group consisting of $C_1$–$C_4$ alkyl, $C_1$–$C_4$ hydroxyalkyl, benzyl, and hydrogen when y is not 0; $R^5$ is the same as $R^4$ or is an alkyl chain wherein the total number of carbon atoms of $R^2$ plus $R^5$ is from about 8 to about 16; each y is from 0 to about 10 and the sum of the y values is from 0 to about 15; and X is any compatible anion.

Preferred of the above are the alkyl quaternary ammonium surfactants, especially the mono-long chain alkyl surfactants described in the above formula when $R^5$ is selected from the same groups as $R^4$. The most preferred quaternary ammonium surfactants are the chloride, bromide and methylsulfate $C_{8-16}$ alkyl trimethylammonium salts, $C_{8-16}$ alkyldi(hydroxyethyl) methylammonium salts, the $C_{8-16}$ alkylhydroxyethyldimethylammonium salts, $C_{8-16}$ alkyloxypropyltrimethylammonium salts, and the $C_{8-16}$ alkyloxypropyl dihydroxyethylmethylammonium salts. Of the above, the $C_{10}$–$C_{14}$ alkyltrimethylammonium salts are preferred, e.g., decyltrimethylammonium methylsulfate, lauryltrimethylammonium chloride, myristyltrimethylammonium bromide and coconut alkyltrimethylammonium chloride and methylsulfate.

Under cold water washing conditions, i.e., less than about 65° F. (18.3° C.), the $C_{8-10}$ alkyl trimethylammonium surfactants are particularly preferred since they have lower Kraft boundaries and crystallization temperatures than the longer chain quaternary ammonium surfactants.

Amine surfactants useful herein are of the formula:

$$[R^2(OR^3)_y][R^4(OR^3)_y]R^5N$$

wherein the $R^2$, $R^3$, $R^4$, $R^5$ and y substituents are as defined above for the quaternary ammonium surfactants. Particularly preferred are the $C_{12-16}$ alkyl dimethyl amines.

Amine oxide surfactants useful herein are of the formula:

$$[R^2(OR^3)_y][R^4(OR^3)_y]R^5N\rightarrow O$$

wherein the $R^2$, $R^3$, $R^4$, $R^5$ and y substituents are also as defined above for the quaternary ammonium surfactants. Particularly preferred are the $C_{12-16}$ alkyl dimethyl amine oxides.

Amine and amine oxide surfactants are preferably used at higher levels than the quaternary ammonium surfactants since they are only partially protonated in the present systems. For example, preferred compositions herein can contain from about 0.5% to about 1.5% of the quaternary ammonium surfactant, or from about 1% to about 3% of the amine or amine oxide surfactants.

Amide surfactants herein are of the formula

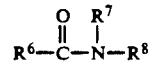

wherein $R^6$ is an alkyl, hydroxyalkyl or alkenyl radical containing from about 8 to about 20 carbon atoms, and $R^7$ and $R^8$ are selected from the group consisting of hydrogen, methyl, ethyl, propyl, isopropyl, 2-hydroxyethyl, 2-hydroxypropyl, 3-hydroxypropyl, and said radicals additionally containing up to about 5 ethylene oxide units, provided at least one of $R^7$ and $R^8$ contains a hydroxyl group.

Preferred amides are the $C_8$–$C_{20}$ fatty acid alkylol amides in which each alkylol group contains from 1 to 3 carbon atoms, and additionally can contain up to about 2 ethylene oxide units. Particularly preferred are the $C_{12}$–$C_{16}$ fatty acid monoethanol and diethanol amides.

It will be noted that some of the preferred surfactants contain acyclic tertiary amines. These amines will be degraded by hypochlorite bleach thus somewhat reducing bleach efficiency. When these surfactants are used in compositions of the invention, some of the increased bleach efficiency gained by replacement of the acyclic tertiary amines in the neutralization system will be offset.

Fatty Acid

The compositions of the present invention preferably contain from 0% to about 20%, more preferably from about 8% to about 18%, most preferably from about 10% to about 16%, by weight of a saturated fatty acid containing from about 10 to about 14 carbon atoms. In addition, the weight ratio of $C_{10}$–$C_{12}$ fatty acid to $C_{14}$ fatty acid is preferably at least 1, more preferably at least 1.5.

Suitable saturated fatty acids can be obtained from natural sources such as plant or animal esters (e.g., palm kernel oil, palm oil and coconut oil) or synthetically prepared (e.g., via the oxidation of petroleum or by hydrogenation of carbon monoxide via the Fisher-Tropsch process). Examples of suitable saturated fatty acids for use in the compositions of this invention include capric, lauric, myristic, coconut and palm kernel fatty acid. Preferred are saturated coconut fatty acids, from about 5:1 to 1:1 (preferably about 3:1) weight ratio mixtures of lauric and myristic acid, mixtures of the above with minor amounts (e.g., 10%–50% of total fatty acid) of oleic acid; and palm kernel fatty acid.

Builder

The compositions herein also contain from 0% to about 30% of detergency builder.

The compositions preferably contain from about 3% to about 20%, more preferably from about 3% to about 6%, more preferably from about 3.5% to about 5% by weight on an acid basis, of a water-soluble polycarboxylate detergent builder material. Polycarboxylate builders are described in U.S. Pat. No. 4,284,532, Leikhim et al, issued Aug. 18, 1981, incorporated herein by reference.

The various aminopolycarboxylates, cycloalkane polycarboxylates, ether polycarboxylates, alkyl polycarboxylates, epoxy polycarboxylates, tetrahydrofuran polycarboxylates, benzene polycarboxylates, and polyacetal polycarboxylates are suitable for use herein.

Examples of such polycarboxylate builders are sodium and potassium ethylenediaminetetraacetate; sodium and potassium nitrilotriacetate; the water-soluble salts of phytic acid, e.g., sodium and potassium phytates, disclosed in U.S. Pat. No. 1,739,942, Eckey, issued Mar. 27, 1956, incorporated herein by reference; the polycarboxylate materials described in U.S. Pat. No. 3,364,103, incorporated herein by reference; and the water-soluble salts of polycarboxylate polymers and copolymers described in U.S. Pat. No. 3,308,067, Diehl, issued Mar. 7, 1967, incorporated herein by reference.

Useful detergent builders also include the water-soluble salts of polymeric aliphatic polycarboxylic acids having the following structural and physical characteristics: (a) a minimum molecular weight of about 350 calculated as to the acid form; (b) an equivalent weight of about 50 to about 80 calculated as to acid form; (3) at least 45 mole percent of the monomeric species having at least two carboxyl radicals separated from each other by not more than two carbon atoms: (d) the site of attachment of the polymer chain of any carboxyl-containg radical being separated by not more than three carbon atoms along the polymer chain from the site of attachment of the next carboxyl-containing radical. Specific examples of such builders are the polymers and copolymers of itaconic acid, aconitic acid, maleic acid, mesaconic acid, fumaric acid, methylene malonic acid, and citraconic acid.

Other suitable polycarboxylate builders include the water-soluble salts, especially the sodium and potassium salts, of mellitic acid, citric acid, pyromellitic acid, benzene pentacarboxylic acid, oxydiacetic acid, carboxymethyloxysuccinic acid, carboxymethyloxymalonic acid, cis-cyclohexanehexacarboxylic acid, cis-cyclopentanetetracarboxylic acid and oxydisuccinic acid.

Other polycarboxylates for use herein are the polyacetal carboxylates described in U.S. Pat. No. 4,144,226, issued Mar. 13, 1979 to Crutchfield et al, and U.S. Pat. No. 4,146,495, issued Mar. 27, 1979 to Crutchfield et al, both incorporated herein by reference.

Citric acid is a highly preferred polycarboxylate builder.

Other builders suitable for use herein include the more conventional builders, such as phosphates, especially pyrophosphate, and phosphonates such as the sodium and potassium salts of ethylene diphosphonic acid, ethane 1-hydroxy, 1-1-diphosphonic acid, and ethanol 1,1,2-triphosphonic acid.

Solvent System

The solvent system for the compositions is preferably comprised of ethanol, and/or a polyol, e.g., propanediol, and water. Ethanol is preferably present at a level of from about 2% to about 10%, more preferably from about 5% to about 9%, by weight of the composition.

Any polyol containing from 2 to 6 carbon atoms and from 2 to 6 hydroxy groups can be used in the present compositions. Examples of such polyols are ethylene glycol, 1,3, propanediol, propylene glycol and glycerine. Propylene glycol is particularly preferred. The polyol preferably represents from about 2% to about 15%, more preferably from about 3% to about 10%, by weight of the composition.

The compositions also preferably contain from about 25% to about 40% more preferably from about 28% to about 37%, by weight of water.

In addition to the above, the ethanol and polyol together preferably represent from about 8% to about 20%, more preferably about 11% to about 16%, by weight of the composition. The ethanol, polyol and water preferably total from about 35% to about 55%, more preferably about 40% to about 50%, by weight of the composition.

The compositions of the present invention preferably have the following limits, in which all percentages and ratios are calculated on an acid basis where anionic materials are involved. The sulfonate, alcohol ethoxylate sulfate, ethoxylated nonionic and quaternary ammonium, amine, amide and/or amine oxide surfactants, together, preferably represent from about 20% to about 40%, more preferably from about 23% to about 30%, by weight of the composition.

The fatty acid and polycarboxylate builder together preferably represent from about 5% to about 30%, more preferably from about 10% to about 25%, by weight of the composition. In addition, the fatty acid, polycarboxylate builder and above surfactants preferably represent a total of from about 33% to about 50%, more preferably from about 36% to about 48%, by weight of the composition.

Finally, all of the above components are selected to provide an isotropic liquid detergent at 55° F. (12.8° C.), preferably at 50° F. (10° C.). The components are also selected to provide an initial pH of from about 7.5 to about 9.0, preferably from about 7.8 to about 8.8, at a concentration of 10% by weight in water at 68° F. (20° C.).

Optional Components

Optional components for use in the liquid detergents herein include enzymes, enzyme stablizing agents, polyacids, soil removal agents, antiredeposition agents, suds regulants, hydrotropes, opacifiers, antioxidants, bactericides, dyes, perfumes, and brighteners described in the U.S. Pat. No. 4,285,841, Barrat et al, issued Aug. 25, 1981, incorporated herein by reference. Such optional components generally represent less than about 15%, preferably from about 2% to about 10%, by weight of the composition.

Enzymes are highly preferred optional ingredients and are incorporated in an amount of from about 0.025% to about 2%, preferably from about 0.05% to about 1.5%. Preferred proteolytic enzymes should provide a proteolytic activity of at least about 5 Anson units (about 1,000,000 Delft units) per liter of product, preferably from about 15 to about 70 Anson units per liter of product, most preferably from about 20 to about 40 Anson units per liter of product. A proteolytic activity of from about 0.01 to about 0.05 Anson units per gram of product is desirable. Other enzymes, including amylolytic enzymes, are also desirably included in the present compositions.

Suitable proteolytic enzymes include the many species known to be adapted for use in detergent compositions. Commercial enzyme preparations such as "Alcalase" sold by Novo Industries, and "Maxatase" sold by Gist-Brocades, Delft, The Netherlands, are suitable. Other preferred enzyme compositions include those commercially available under the tradenames SP-72 ("Esperase") manufactured and sold by Novo Industries, A/S, Copenhagen, Denmark and "AZ-Protease" manufactured and sold by Gist-Brocades, Delft, The Netherlands.

Suitable amylases include "Rapidase" sold by Gist-Brocades and "Termamyl" sold by Novo Industries.

A more complete disclosure of suitable enzymes can be found in U.S. Pat. No. 4,101,457, Place et al, issued July 18, 1978, incorporated herein by reference.

When enzymes are incorporated in the detergent compositions of this invention, they are desirably stabilized by using a mixture of a short chain carboxylic acid salt and calcium ion, such as disclosed in U.S. Pat. No. 4,318,818. Letton et al, issued Mar. 9, 1982, incorporated herein by reference.

The short chain carboxylic acid salt is preferably watersoluble, and most preferably is a formate, e.g., sodium formate. The short chain carboxylic acid salt is used at a level from about 0.25% to about 10%, preferably from about 0.3% to about 3%, more preferably from about 0.5% to about 1.5%. Any water-soluble calcium salt can be used as a source of calcium ion, including calcium acetate, calcium formate and calcium propionate. The composition should contain from about 0.1 to about 30 milimoles of calcium ion per liter, preferably from about 0.5 to about 15 millimoles of calcium ion per liter. When materials are present which complex calcium ion, it is necessary to use high levels of calcium ion so that there is always some minimum level available for the enzyme.

Enzymes are preferably stabilized in the present compositions by the addition of from about 0.25% to about 10%, preferably from about 0.5% to about 5%, more preferably from about 0.75% to about 3%, by weight of boric acid or a compound capable of forming boric acid in the composition (calculated on the basis of the boric acid). Boric acid is preferred, although other compounds such as boric oxide, borax and other alkali metal borates (e.g., sodium ortho-, meta- and pyroborate, and sodium pentaborate) are suitable. Substituted boric acids (e.g., phenylboronic acid, butane boronic acid, and p-bromo phenylboronic acid) can also be used in place of boric acid.

The combination of boric acid and formate provides improved protease stability, although amylase stability appears to be slightly less than that obtained using boric acid alone.

Preferred compositions also contain from about 0.01% to about 1% of a polyacid or salt thereof, to enhance pretreatment performance. Preferred polyacids for use herein are ethylenediamine tetramethylenephosphonic acid, diethylenetriamine pentamethylenephosphonic acid, and diethylenetriaminepentaacetic acid, or the salts thereof. These polyacids/salts are preferably used in an amount from about 0.1% to about 0.8%.

Preferred compositions herein further contain from about 0.5% to about 3%, preferably from about 1% to about 2%, by weight of a highly ethoxylated polyethyleneamine or polyethyleneimine soil removal and antiredeposition agent, such as those described in pending U.S. patent application Ser. No. 452,463, Vander Meer, filed Dec. 23, 1982. A particularly preferred material is tetraethylenepentamine ethoxylated with about 15–18 moles of ethylene oxide at each hydrogen site.

The following examples illustrate the compositions of the present invention.

All parts, percentages and ratios used herein are by weight unless otherwise specified.

EXAMPLE I

A liquid detergent composition of the present invention is as follows:

| Components | % |
|---|---|
| $C_{14-15}$ alkyl polyethoxylate (2.25) sulfuric acid half ester | 12.0 |
| $C_{13}$ alkyl benzene sulfonic acid | 8.0 |
| $C_{12-13}$ alkyl polyethoxylate (6.5) | 5.0 |
| $C_{12}$ alkyl trimethylammonium chloride | 0.6 |
| Coconut middle cut fatty acid | 7.7 |
| Palm kernel oil fatty acid | 3.3 |
| Diethylenetriaminepentaacetic acid | 0.3 |
| Citric acid | 4.0 |
| Quinuclidene | 2.5 |
| Ethanol | 7.0 |
| 1,2 propanediol | 6.5 |
| Sodium hydroxide | 2.0 |
| Potassium hydroxide | 5.4 |
| Tetraethylenepentamine ethoxylated with ~16 moles of ethylene oxide at each hydrogen | 2.0 |
| Water, enzymes, brighteners, etc. | Balance |
| pH of product ~8.3 | |

COMPARATIVE EXAMPLE II

Various amines/imines were tested for chlorine bleach compatibility. The amines were dissolved in distilled water, and a commercially available chlorine bleach was added to a final concentration of 4000 parts per million (210 mm NaOCl). At 2, 6, and 10 minutes, aliquots were taken, the reaction quenched, and the amount of unreacted NaOCl was determined by volumetric titration using ferrous ammonium sulfate. All experiments were performed at room temperature and pH9; pH being measured after addition of chlorine bleach. A phosphate buffer was used to control pH.

Reaction Rates and Stoichiometries of NaOCl with Tertiary Amines

| | | Moles NaOCl Consumed/ Mole Amine | | | Moles NaOCl Consumed/ Mole Nitrogen | | |
|---|---|---|---|---|---|---|---|
| Amine* | Level (ppm) | 2 Min | 6 Min | 10 Min | 2 Min | 6 Min | 10 Min |
| MEA | 60 | 1.9 | 1.9 | 1.9 | 1.9 | 1.9 | 1.9 |
| DEA | 100 | 1.0 | 1.0 | 1.0 | 1.0 | 1.0 | 1.0 |
| TEA | 80 | 1.6 | 2.0 | 2.3 | 1.6 | 2.0 | 2.3 |
| DTPA | 20 | 6.8 | 8.1 | 8.7 | 2.3 | 2.7 | 2.9 |
| DCEA | 30 | 12 | 12 | 15 | 2.4 | 2.4 | 3.0 |
| EDA-E3 | 100 | 4.6 | 5.6 | 5.6 | 2.3 | 2.8 | 2.8 |
| AEP-E3 | 100 | 3.3 | 4.1 | 4.4 | 1.1 | 1.4 | 1.5 |

*Amines:
MEA-monoethanol amine, DEA-diethanol amine, TEA-triethanol amine, DTPA-diethylenetriamine pentaacetic acid, ethoxylated polyethylene amine-ethoxylated-(E16)-tetraethylene pentamine, EDA-E3-ethoxylated-(E3)-ethylenediamine, AEP-E3-ethoxylated-(E3)-(a-aminoethyl) piperzine, DCEA-dichloroethoxylated amines.

Those tertiary amines having a stoichiometry (mol Na OCl per 1 mole nitrogen) greater than one are "fragmented" during the reaction.

EXAMPLE III

Various amines/imines were tested for chlorine bleach compatibility. The amines were dissolved in distilled water, and a commercially available chlorine bleach was added to a final concentration of 4000 parts per million (210) mm NaOCl). At 2, 6, and 10 minutes, aliquots were taken, the reaction quenched, and the amount of unreacted NaOCl was determined by volumetric titration using ferrous ammonium sulfate. All experiments were performed at room temperature and pH9; pH being measured after addition of chlorine bleach. A phosphate buffer was used to control pH.

| | Moles Na OCl Consumed 1 Mole Nitrogen | | |
|---|---|---|---|
| | 2 min. | 6 min. | 10 min. |
| Quinuclidene | 0.2 | 0.2 | 0.3 |
| DBU | 0.05 | 0.05 | 0.1 |
| Hexamethylene tetraamine | 0.4 | 0.4 | 0.4 |

What is claimed is:

1. A heavy-duty liquid composition comprising, by weight:

(a) from about 10% to about 35%, of anionic surfactant on an acid basis;

(b) from 0% to about 15% of ethoxylated nonionic surfactant of the formula $R^1(OC_2H_4)_nOH$, wherein $R^1$ is a $C_{10}$–$C_{16}$ alkyl group or a $C_8$–$C_{12}$ alkyl phenyl group, n averages from about 3 to about 9, and said nonionic surfactant has an HLB of from about 10 to about 13;

(c) from about 0% to about 15% of a cosurfactant selected from the group consisting of:

(i) quaternary ammonium surfactants having the formula:

$$[R^2(OR^3)_y][R^4(OR^3)_y]_2R^5N^+X^-$$

wherein $R^2$ is an alkyl or alkyl benzyl group having from about 6 to about 16 carbon atoms in the alkyl chain; each $R^3$ is selected from the group consisting of $—CH_2CH_2—$, $—CH_2CH(CH_3)—$, $—CH_2CH(CH_2OH)—$, $—CH_2CH_2CH_2—$, and mixtures thereof; each $R^4$ is selected from the group consisting of $C_1$–$C_4$ alkyl, $C_1$–$C_4$ hydroxyalkyl, benzyl, and hydrogen when y is not 0; $R^5$ is the same as $R^4$ or is an alkyl chain wherein the total number of carbon atoms of $R^2$ plus $R^5$ is from about 8 to about 16; each y averages from 0 to about 10 and the sum of the y values is from 0 to about 15; and X is any compatible anion;

(ii) amine surfactants having the formula:

$$[R^2(OR^3)_y][R^4(OR^3)_y]R^5N$$

wherein $R^2$, $R^3$, $R^4$, $R^5$ and y are as defined above;

(iii) amine oxide surfactants having the formula:

$$[R^2(OR^3)_y][R^4(OR^3)_y]R^5N\rightarrow 0$$

wherein $R^2$, $R^3$, $R^4$, $R^5$ and y are as defined above;

(iv) an amide surfactant of the formula:

$$R^6—\overset{\overset{\displaystyle O}{\|}}{C}—\overset{\overset{\displaystyle R^7}{|}}{N}—R^8$$

wherein $R^6$ is an alkyl, hydroxyalkyl or alkenyl radical containing from about 8 to about 20 carbon atoms, and $R^7$ and $R^8$ are each selected from the group consisting of hydrogen, methyl, ethyl, propyl, isopropyl, 2-hydroxyethyl, 2-hydroxypropyl, 3-hydroxypropyl, and wherein said radicals additionally contain up to about 5 ethylene oxide units; and (v) mixtures thereof;

(d) from 0% to about 30% of detergent builder;

(e) a neutralization system comprising from about 0.5% to about 10% of a bicyclic tertiary amine or imine selected from the group consisting of quinuclidine; 1,8-diazobicyclo [5.4.0] undec-7-ene; hexamethylene tetraamine and mixtures thereof; and (f) an aqueous solvent system.

2. The composition of claim 17 wherein component (e) comprises from about 1% to about 5% of the composition.

3. The composition of claim 2 wherein the bicyclic tertiary amine or imine is quinuclidine.

4. The composition of claim 2 wherein the bicyclic tertiary amine or imine is 1,8-diazobicyclo [5.4.0] undec-7-ene.

5. The composition of claim 1 wherein the bicyclic tertiary amine or imine is quinuclidine.

6. The composition of claim 1 wherein the bicyclic tertiary amine or imine is 1,8 diazobicyclo [5.4.0] undec-7-ene.

7. The composition of claim 1 wherein the anionic surfactant comprises:

(a) from about 5% to about 15%, on an acid basis, of a sulfonate surfactant containing a $C_{10}$–$C_{16}$ alkyl or alkenyl group; and (b) from about 8% to about 18%, on an acid basis, of an alcohol ethoxylate sulfate surfactant of the formula $RO(C_2H_4O)_mSO_3M$, wherein R is a $C_{10}$–$C_{16}$ alkyl or hydroxyalkyl group, m is from about 0.5 to about 4, and M is a compatible cation; and (c) from about 2% to about 15% of an ethoxylated nonionic surfactant of the formula $R^1(OC_2H_4)_nOH$, wherein $R^1$ is a $C_{10}$–$C_{16}$ alkyl group or a $C_8$–$C_{12}$ alkyl phenyl group, n is from about 3 to about 9, and said nonionic surfactant has an HLB of from about 10 to about 13.

8. The composition of claim 7 wherein the sulfonate surfactant is a $C_{11}$–$C_{13}$ linear alkylbenzene sulfonate; in the alcohol ethoxylate sulfate surfactant, R is a $C_{12}C_{15}$ alkyl group and m is from about 1.5 to about 3; and in the ethoxylated nonionic surfactant, R is a $C_{12}$–$C_{14}$ alkyl group and n is from about 3 to about 7.

9. The composition of claim 8 also comprising from about 0.5% to about 3% of the cosurfactant, which is a $C_{10}$–$C_{14}$ alkyl trimethylammonium chloride, bromide or methylsulfate.

10. The composition of claim 9 wherein the builder comprises a polycarboxylate builder.

11. The composition of claim 10 in which the builder comprises from about 10% to about 16% of saturated fatty acid and from about 3% to about 6% of citric acid.

12. The composition of claim 11 comprising from about 6% to about 10% of the sulfonate surfactant, from about ;9% to about 14% of the alcohol ethoxylate sulfate surfactant, from about 4% to about 10% of the ethoxylated nonionic surfactant, and from about 0.5% to about 1.5% of the cosurfactant, which is a $C_{10}$–$C_{14}$ alkyl trimethylammonium chloride, bromide or methylsulfate.

13. The composition of claim 12 comprising from about 5% to about 9% of ethanol, from about 3% to about 10% of the polyol, which is propylene glycol, and from about 28% to about 37% of water.

14. The composition of claim 13 having an initial pH of from about 7.8 to about 9.0 at a concentration of 10% by weight in water at 68° F. (20° C.).

* * * * *